US007409932B2

(12) United States Patent
Gaiser

(10) Patent No.: US 7,409,932 B2
(45) Date of Patent: Aug. 12, 2008

(54) SLIDING JOINT FOR VARIABLE COMPRESSION RATIO DEVICE

(76) Inventor: Randall Gaiser, 13285 Oakridge La., Chelsea, MI (US) 48118

( * ) Notice: Subject to any disclaimer, the term of this patent is extended or adjusted under 35 U.S.C. 154(b) by 0 days.

(21) Appl. No.: 11/541,440

(22) Filed: Sep. 29, 2006

(65) Prior Publication Data

US 2007/0181085 A1 Aug. 9, 2007

Related U.S. Application Data

(60) Provisional application No. 60/721,853, filed on Sep. 29, 2005.

(51) Int. Cl.
*F02B 75/18* (2006.01)
*F02B 75/26* (2006.01)
*F01B 13/04* (2006.01)

(52) U.S. Cl. ..... 123/56.2; 123/56.8; 91/507

(58) Field of Classification Search ..... 123/202, 123/56.1–56.9, 48 R, 78 R; 91/507; 92/12.2; 74/60

See application file for complete search history.

(56) References Cited

U.S. PATENT DOCUMENTS 2,243,817 A * 5/1941 Herrmann ..... 123/41.31
3,139,038 A * 6/1964 Stewart ..... 91/507
3,207,082 A * 9/1965 Pitt et al. ..... 91/507
3,241,495 A * 3/1966 Diedrich et al. ..... 91/507
3,319,874 A * 5/1967 Welsh ..... 123/56.4
4,936,155 A * 6/1990 Gogins ..... 74/117
5,094,195 A 3/1992 Gonzalez
5,437,251 A * 8/1995 Anglim et al. ..... 123/56.3
5,553,582 A * 9/1996 Speas ..... 123/56.4

* cited by examiner

*Primary Examiner*—Willis R Wolfe, Jr.
(74) *Attorney, Agent, or Firm*—Gifford, Krass, Sprinkle, Anderson & Citkowski, P.C.

(57) ABSTRACT

A barrel-type internal combustion engine includes a power output shaft assembly with a sliding joint. A power output shaft has a pair of spaced apart bearing surfaces and a plurality of radial splines between the bearing surfaces. A cam plate has a central hub and a cam track extending therefrom. The central hub has a longitudinal bore for receiving the shaft. The bore has a pair of spaced apart bearing surfaces and a plurality of radial splines between the bearing surfaces. When assembled, the power shaft is received in the bore of the hub, the bearing surfaces are generally aligned and the splines engage such that the shaft and cam plate are coupled for rotation about the rotational axis of the shaft and the cam plate is longitudinally slidable on the shaft.

13 Claims, 4 Drawing Sheets

FIG - 4
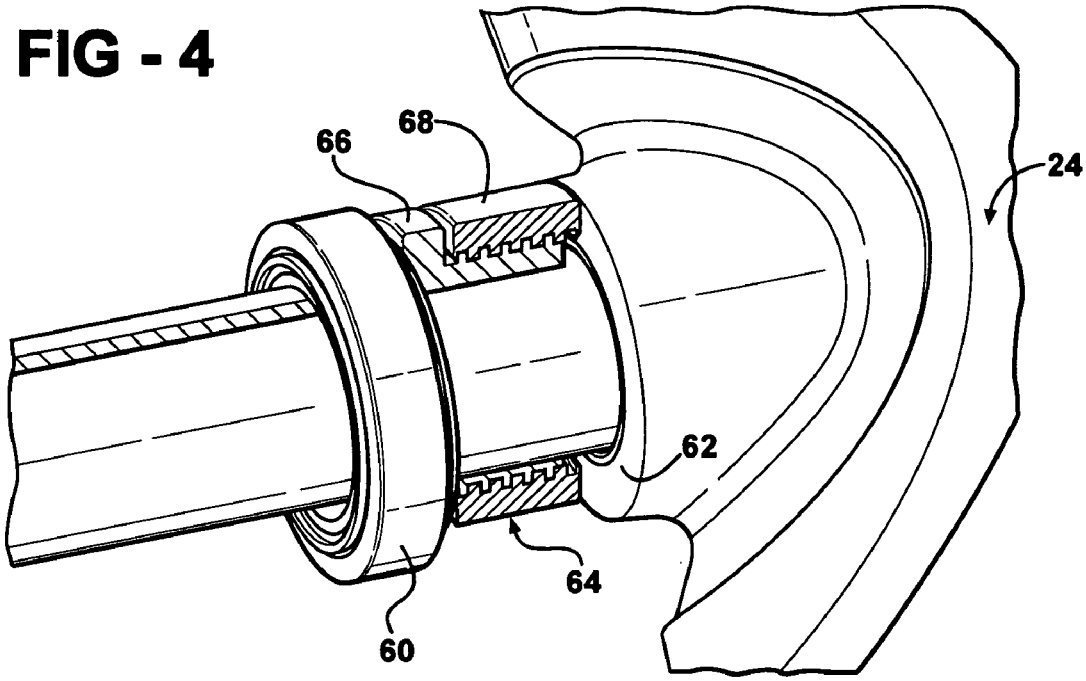
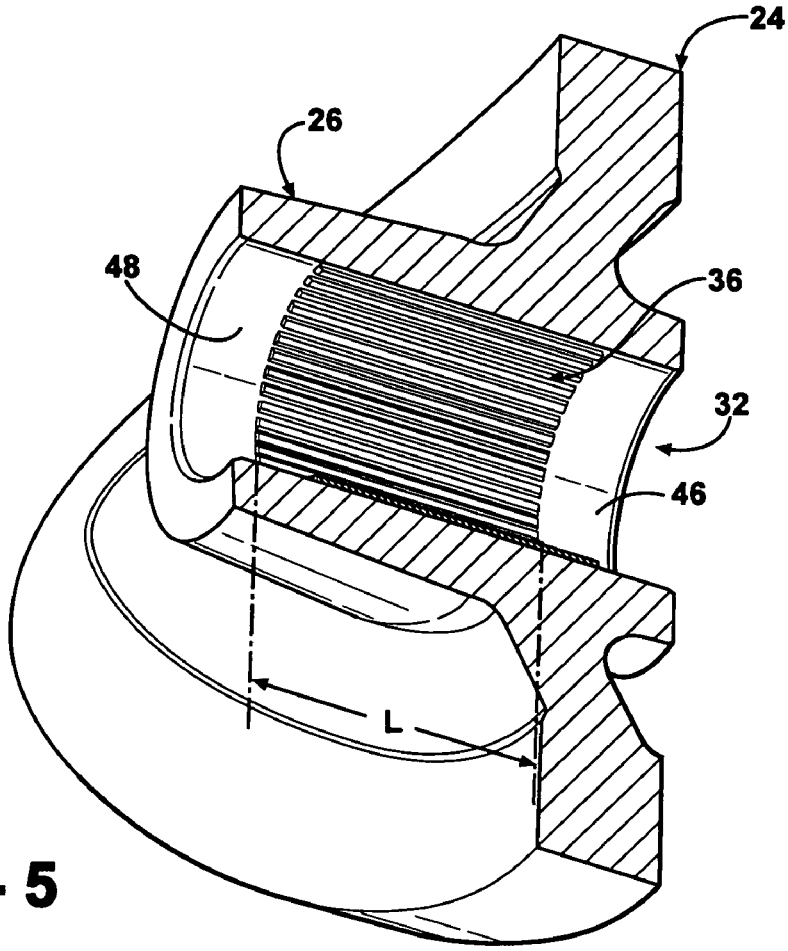
FIG - 5

SLIDING JOINT FOR VARIABLE COMPRESSION RATIO DEVICE

REFERENCE TO RELATED APPLICATIONS

This application claims priority from U.S. Provisional Patent Application Ser. No. 60/721,853, filed Sep. 29, 2005, the entire content of which is incorporated herein by reference.

FIELD OF THE INVENTION

The present invention relates to a sliding joint for a power output shaft assembly in a barrel-type internal combustion engine.

BACKGROUND OF THE INVENTION

Internal combustion engines are widely used for driving a variety of vehicles. Internal combustion engines come in a variety of configurations, which are typically aptly named for the particular orientation or arrangement of the reciprocating pistons and cylinders in the engines. One example of an internal combustion engine is a "V" type engine, in which the "V" refers to the arrangement of the cylinders in rows that are angled relative to each other to form a V shape. Another type of internal combustion engine that is most relevant to the invention is a barrel-type engine.

Barrel engines typically include a plurality of cylinders and pistons arranged in the form of a "barrel" in which their axes are parallel to each other and arranged along a circle concentric with the power output shaft. Power is transmitted from the reciprocating pistons to a cam plate via a sliding or roller interface. The cam plate's nominal plane is perpendicular to the piston axes and attached to the output shaft. One variation, commonly referred to as a double-ended barrel engine, typically uses a double-ended piston construction and utilizes pistons that have power cylinders at each end. Another configuration of the barrel engine concept, commonly known as a single-ended barrel engine, only uses power cylinders on one end of the piston.

SUMMARY OF THE INVENTION

The present invention provides a barrel-type internal combustion engine and a power output shaft assembly for use there with. The power output shaft assembly includes an elongated power output shaft defining a longitudinally extending rotational axis. The output shaft has an outer surface with a pair of spaced apart bearing surfaces defined thereon and a plurality of radial splines defined thereon between the spaced apart bearing surfaces. The splines each extend longitudinally along the outer surface of the shaft. The assembly also includes a cam plate having a central hub and a cam track extending therefrom. The central hub has a longitudinal bore defined therethrough, the bore having an inner surface with a pair of spaced apart bearing surfaces defined thereon. A plurality of radial splines are defined on the inner surface of the hub between the spaced apart bearing surfaces. The splines each extend longitudinally along the inner surface. When the power output shaft assembly is complete, the elongated power shaft is received in the bore of the hub, the bearing surfaces of the shaft and hub are generally aligned and the splines of the shaft engage the splines of the hub such that the shaft and cam plate are coupled for rotation about the rotational axis of the shaft and the cam plate is longitudinally slidable on the shaft.

BRIEF DESCRIPTION OF THE DRAWINGS

Advantages of the present invention will be readily appreciated as the same becomes better understood by reference to the following detailed description when considered in connection with the accompanying drawings, wherein:

FIG. 4 is an enlarged perspective view of a portion of the power output shaft in which a variable compression device is shown cut away; and FIG. 5 is a cross sectional perspective view of an embodiment of a cam plate according to the present invention.

DETAILED DESCRIPTION OF THE INVENTION

In a barrel-type internal combustion engine, a variable compression ratio feature may be provided if the longitudinal position of the cam plate relative to the cylinders is adjustable. The present invention provides a sliding joint for interconnecting the cam plate with the power output shaft. Embodiments of the present invention allow longitudinal adjustment while resisting rocking forces.

Figure 1:
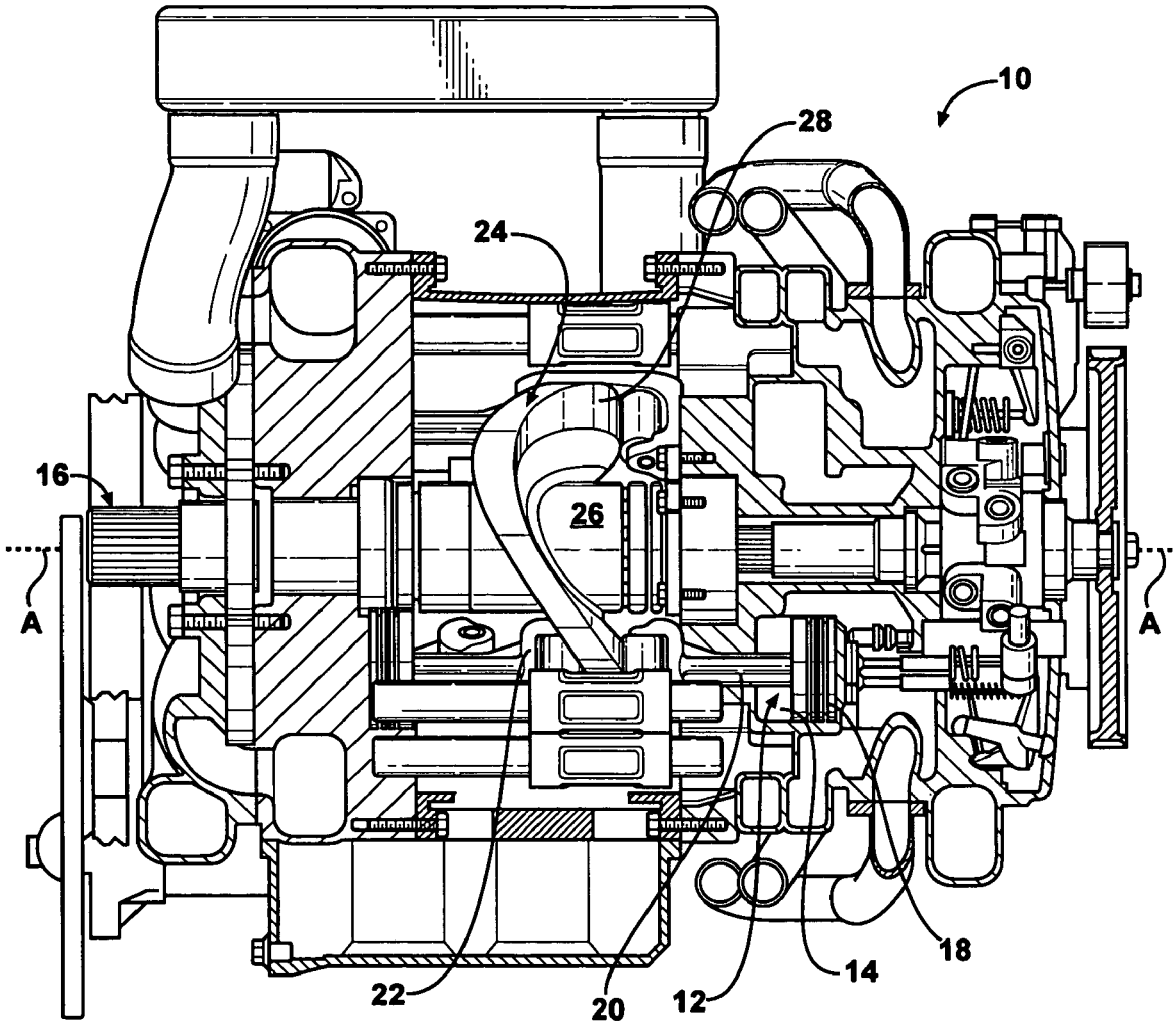
FIG. 1 is a side view of an embodiment of a barrel-type internal combustion engine with portions cut away so as to show internal components.

In FIG. 1, a perspective view of a portion of a barrel-type internal combustion engine is generally indicated at 10. The engine 10 includes a plurality of piston assemblies 12 and cylinders 14 each having axes that are generally parallel with a power output shaft 16. The power output shaft 16 may be said to define a longitudinally extending axis of rotation A. The pistons 12 and cylinders 14 are arranged in a circular formation concentric with the power output shaft 16.

Each piston assembly 12 includes a piston 18 disposed in a cylinder 14 and a rod 20 extending longitudinally from the piston 12. The distal end of the rod 20 includes a bearing portion 22, which in this embodiment consists of a pair of roller bearings. The bearing portion 22 is in mechanical communication, such as by rolling or sliding, with a shaped cam plate 24.

The cam plate 24 has a central hub 26 and a cam track 28 extending therefrom. The cam track preferably has a pair of generally parallel undulating surfaces, which may have a sinusoidal or non-sinusoidal profile. The central hub 26 of the cam plate 24 is supported on the output shaft 16. Reciprocal motion of the pistons 12 within their respective cylinders 14 forces the bearing portion 22 in a longitudinal axial direction against the surface of the cam track 28, in turn, causing rotational movement of the output shaft 16.

Figure 2:
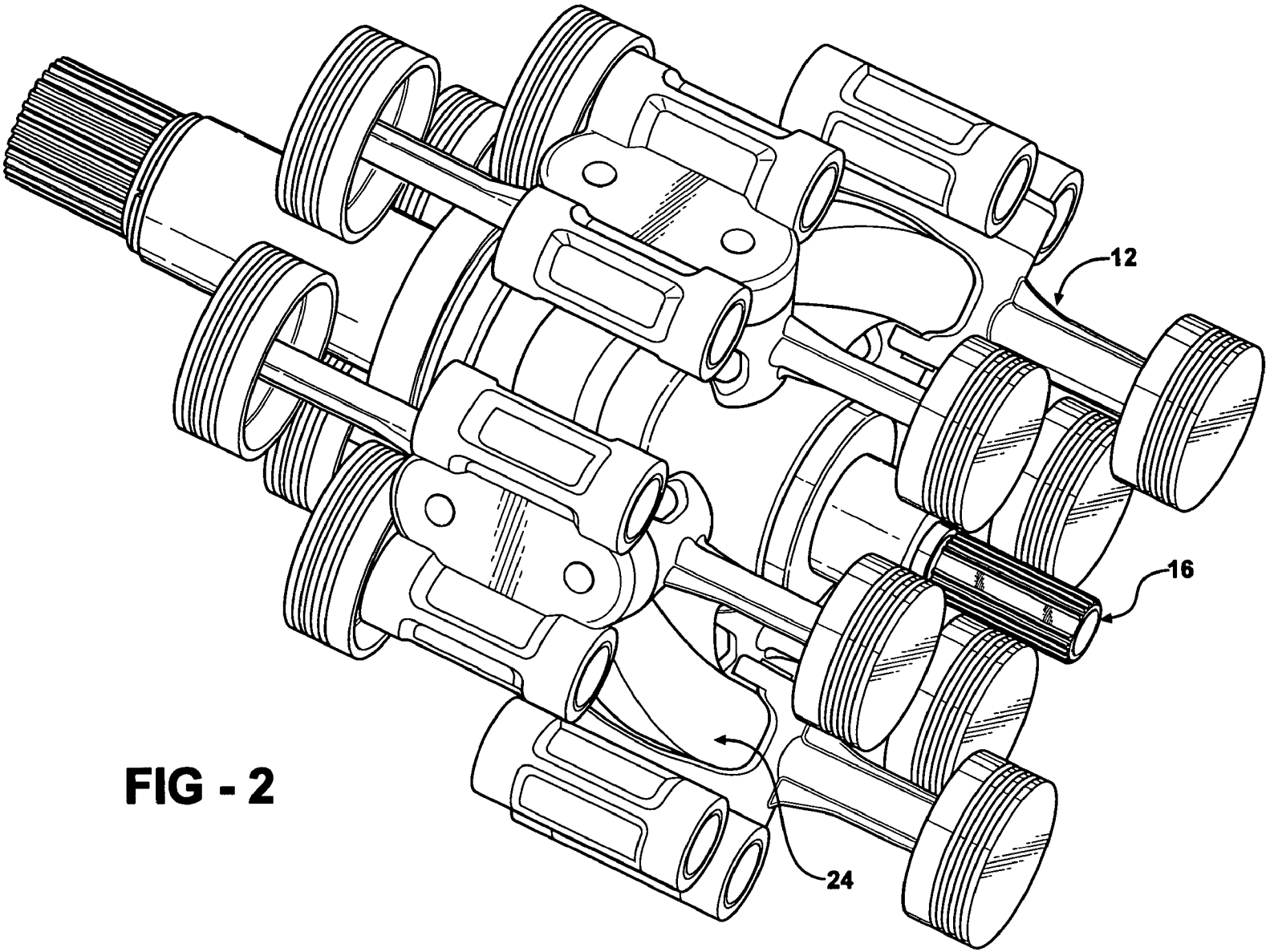
FIG. 2 is a perspective view of a portion of the engine of FIG. 1.
Figure 3:
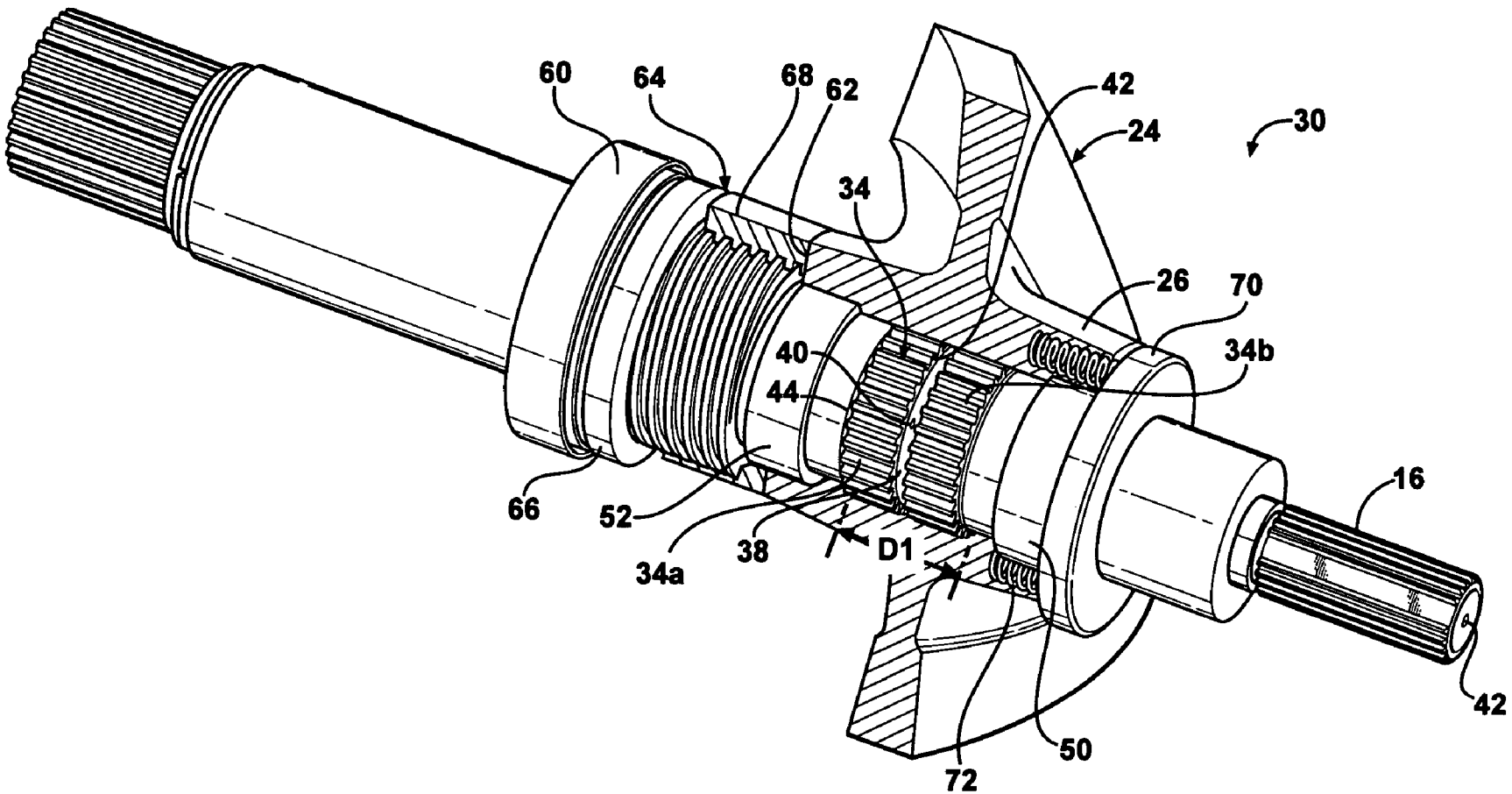
FIG. 3 is a perspective view of an embodiment of a power output shaft assembly for a barrel-type engine in which a variable compression device and cam plate are shown partially cut away.

FIG. 2 provides a perspective view of several piston assemblies 12, the output shaft 16 and cam plate 24. Together, the output shaft 16 and cam plate 24 form an output shaft assembly 30, as shown in FIG. 3. Referring to FIG. 5, the central hub 26 has a longitudinal bore 32 defined therethru and, as shown in FIG. 3, the output shaft 16 is received in the bore. A plurality of radial splines 34 extend outwardly from the outer surface of the output shaft 16. A corresponding plurality of radial splines 36 extend inwardly from the inner surface of the bore 32 in the hub 26. The splines on the output shaft and in the hub each extend longitudinally along the respective surfaces and are preferably parallel to the axis A. The splines 34 on the output shaft 16 engage the corresponding splines 36 in the hub 26 when the output shaft 16 is received in the bore 32 such that the output shaft and cam plate are coupled together for rotation. However, the splines allow for longitudinal movement of the cam plate relative to the output shaft.

Referring again to FIG. 3, the splines 34 on the output shaft 16 are preferably arranged in two rows or sets, 34*a* and 34*b* which are spaced apart by a lubrication groove 38. The splines 36 in the hub 26 of the cam plate 24 are preferably arranged in a single row or set, as shown in FIG. 5. The lubrication groove 38 allows pressurized oil to be fed to the splines from an oil feed bore 40. The oil feed bore 40 may be in fluid communication with a longitudinal oil feed bore 42 extending thru the output shaft 16. The splines in each set 34*a* and 34*b* may be said to extend from an inner end 42 to an outer end 44. The outer ends 44 of the two sets are separated by a first distance D1. The splines 36 in the hub preferably have a length L approximately the same as the distance D1.

It should be readily apparent to one skilled in the art that the output shaft 16 and cam plate 24 can have any number of rows of teeth and lubrication grooves as necessary to meet a desired torque handling and lubrication capacity. For example, the output shaft 16 can have a single row of teeth and/or the cam plate 24 can have multiple rows of teeth.

The cam plate 24 also includes a pair of spaced apart annular bearing surfaces 46, 48 disposed on opposite ends of the set of splines 36. The bearing surfaces may be immediately adjacent the splines 36 or spaced therefrom. The bearing surfaces may be part of the hub 26 itself of may be formed by bearings inserted into the hub. Referring again to FIG. 3, the output shaft 16 has a corresponding pair of bearing surfaces 50 and 52 defined thereon. These surfaces may be part of the shaft itself or formed by bearings on the shaft. The bearing surfaces 50 and 52 are positioned such that when the shaft 16 is disposed in the bore 32 and the splines are engaged, the bearing surfaces 50 and 52 are aligned with the bearing surfaces 46 and 48 respectively. The pressurized oil fed to the splines may also pressurize the bearing surfaces, or separate oil feeds by be provided. The bearings defined by the bearing surfaces resist off-axis or rocking movement of the cam plate 24 relative to the output shaft 16.

As will clear to those of skill in the art, the output shaft 16 needs to be rotationally supported within the engine housing. In the illustrated embodiment, a bearing member 60 in the form of a tapered roller bearing is secured to the output shaft 16. The bearing member 60 is axially spaced apart from an abutment end 62 of the cam plate 24. A second hole (not shown) may be provided in the output shaft 16 for feeding oil to the bearing member 60.

A variable compression ratio device 64 is positioned in the space between the bearing member 60 and the abutment end 62 of the cam plate 24. As will be clear to those of skill in the art, the variable compression ratio device for use with the present invention may take a variety of forms. Preferably the device is operable to move the cam plate 24 longitudinally relative to the cylinders in the engine, thereby altering the compression ratio. This may be accomplished by maintaining the longitudinal position of the output shaft 16 while adjusting the longitudinal position of the cam plate on the output shaft. Any variable compression ratio device operable to move the cam plate 24 on the output shaft may be used with or as part of the present invention. According to one embodiment of the invention, as shown in FIGS. 3 and 4, the variable compression ratio device 64 includes an inner sleeve 66 and an outer sleeve 68. The inner sleeve 66 is fixedly secured to the output shaft 16 and positioned adjacent the bearing member 60. The outer sleeve 68 is threadingly engaged with the inner sleeve 66, so that rotation of the outer sleeve 68 causes longitudinal displacement of the outer sleeve 68 relative to the inner sleeve 66. Thus, the longitudinal length of the variable compression ratio device 64 is shortened or lengthened by rotating the outer sleeve 66 relative to the inner sleeve 68.

In the illustrated embodiment, the output shaft 16 includes a radially outwardly extending shoulder 70 adjacent the end of the cam plate opposite the abutment end 62. A plurality of biasing members 72 are compressed between the shoulder 70 of the output shaft 16 and the cam plate 24. The biasing members 72 continuously bias the cam plate 24 toward the variable compression ratio device 64. The biasing members 72 shown in the figures are helical coil springs, though it should be readily apparent that the biasing members 72 can be any suitable type known to persons having ordinary skill in the art.

In use, the pistons 18 reciprocate in their respective cylinders and exert axial forces on the cam plate 24. Axial forces on the cam plate 24 are converted to torsional forces about the axis of the output shaft 16 due to the generally sinusoidal shape of the cam plate 24. The torsional forces cause rotational movement of the cam plate 24. The roller bearings minimize friction between the piston assemblies 12 and the cam plate 24 as the cam plate 24 rotates about the axis of the output shaft 16. The output shaft 16 rotates with the cam plate 24 due to engagement between the splines 34 and 36. Off-axis forces due to 'rocking' between the cam plate 24 and output shaft 16 are carried by the bearings created between bearing surfaces 46 and 50 and between bearing surfaces 48 and 52. Longitudinal forces are carried by the variable compression ratio device 64 and the shoulder 70 of the output shaft 16.

The compression ratio of the engine 10 is adjusted by selectively adjusting the variable compression ratio device. For the illustrated embodiment, rotation of the outer sleeve 68 in one direction shortens the variable compression ratio device 64, while rotation in an opposite direction lengthens the variable compression ratio device 64. The shortening and lengthening of the variable compression ratio device in the direction of the rotational axis causes corresponding adjustments in the midpoint of the stroke of the pistons 18, which in turn proportionally effects the compression ratio. The rotation of the outer sleeve 68 relative to the inner sleeve 66 is performed either manually or automatically by any actuator known by those having ordinary skill in the art, such as a hydraulic actuator or electric motor.

It should be readily appreciated by those having ordinary skill in the art that the variable compression ratio device can be any apparatus that allows displacement of the cam plate in the direction of the rotational axis of the output shaft to cause changes to the stroke and, ultimately, the compression ratio. For example, a mechanical or hydraulic actuator can be operatively coupled between a fixed point on the engine or vehicle body and the cam plate for moving the cam plate along the rotational axis of the output shaft. In another example, the cam plate may be fixedly secured to the drive shaft for rotation therewith about the rotational axis. In this example, the cam plate and drive shaft are displaced together along the rotational axis by a variable compression ratio device to cause changes to the compression ratio.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

I claim:

1. A power output shaft assembly for use in a barrel-type internal combustion engine of the type having a plurality of cylinders disposed about the power output shaft assembly, the power output shaft assembly comprising:

an elongated power output shaft defining a longitudinally extending rotational axis, the output shaft having an outer surface with a pair of spaced apart bearing surfaces defined thereon, the output shaft further having a plurality of radial splines defined thereon between the spaced apart bearing surfaces, the splines each extending longitudinally along the outer surface; and a cam plate having a central hub and a cam track extending therefrom, the central hub having a longitudinal bore defined therethru, the bore having an inner surface with a pair of spaced apart bearing surfaces defined thereon, the cam plate further having a plurality of radial splines defined thereon between the spaced apart bearing surfaces, the splines each extending longitudinally along the inner surface;

wherein the elongated power shaft is received in the bore of the hub, the bearing surfaces of the shaft and hub are generally aligned and the splines of the shaft engage the splines of the hub such that the shaft and cam plate are coupled for rotation about the rotational axis of the shaft and the cam plate is longitudinally slidable on the shaft.

2. The power output shaft assembly as set forth in claim 1, wherein the output shaft further comprises a pair of bearing journal members each disposed on the outer surface, the bearing journal members defining the bearing surfaces on the output shaft.

3. The power output shaft assembly as set forth in claim 1, wherein the cam plate further comprises a pair of bearing journal members each disposed in the bore, the bearing journal members defining the bearing surfaces in the hub.

4. The power output shaft assembly as set forth in claim 1, wherein the plurality of splines defined on the outer surface comprise a first and a second set of splines, the first set being spaced longitudinally from the second set so as to define an annular gap therebetween.

5. The power output shaft assembly as set forth in claim 4, wherein the output shaft further has a longitudinal oil feed bore extending therethru and a radial oil feed bore extending from the longitudinal bore to an opening in the outer surface, the opening being disposed in the annular gap.

6. The power output shaft assembly as set forth in claim 4, wherein:

each of the splines in the first set extend from an inner end adjacent the gap to an opposed outer end;

each of the splines in the second set extend from an inner end adjacent the gap to an opposed outer end;

the outer ends of the splines in the first set being spaced from the outer ends of the splines in the second set by a first distance;

each of the splines in the bore having a longitudinal length approximately the same as the first distance.

7. The power output shaft assembly as set forth in claim 1, further comprising a variable compression ratio device operable to vary the longitudinal position of the cam plate relative to the output shaft.

8. The power output shaft assembly as set forth in claim 7, wherein the output shaft further includes an outwardly extending shoulder, the cam plate being retained longitudinally between the shoulder and the variable compression ratio device.

9. The power output shaft assembly as set forth in claim 8, further comprising a biasing member continuously biasing the cam plate in a direction generally parallel with the rotational axis toward the variable compression device.

10. A barrel-type internal combustion engine comprising:

a power output shaft assembly having:

an elongated power output shaft defining a longitudinally extending rotational axis, the output shaft having an outer surface with a pair of spaced apart bearing surfaces defined thereon, the output shaft further having a plurality of radial splines defined thereon between the spaced apart bearing surfaces, the splines each extending longitudinally along the outer surface; and a cam plate having a central hub and a cam track extending therefrom, the central hub having a longitudinal bore defined therethru, the bore having an inner surface with a pair of spaced apart bearing surfaces defined thereon, the cam plate further having a plurality of radial splines defined thereon between the spaced apart bearing surfaces, the splines each extending longitudinally along the inner surface;

wherein the elongated power shaft is received in the bore of the hub, the bearing surfaces of the shaft and hub are generally aligned and the splines of the shaft engage the splines of the hub such that the shaft and cam plate are coupled for rotation about the rotational axis of the shaft and the cam plate is longitudinally slidable on the shaft;

an engine housing receiving the power output shaft assembly, the engine housing defining at least one cylinder extending generally parallel to the rotational axis of the output shaft;

a piston assembly having a piston disposed in the cylinder and a bearing portion in mechanical communication with the cam track of the cam plate and a variable compression ratio device operatively coupled to the output shaft and cam plate for allowing selective displacement of the cam plate along the rotational axis, thereby effecting a corresponding change in the compression ratio of the engine.

11. The engine as set forth in claim 10, wherein the plurality of splines defined on the outer surface of the output shaft comprise a first and a second set of splines, the first set being spaced longitudinally from the second set so as to define an annular gap therebetween.

12. The engine as set forth in claim 11, wherein the output shaft further has a longitudinal oil feed bore extending therethru and a radial oil feed bore extending from the longitudinal bore to an opening in the outer surface, the opening being disposed in the annular gap.

13. The engine as set forth in claim 11, wherein:

each of the splines in the first set extend from an inner end adjacent the gap to an opposed outer end;

each of the splines in the second set extend from an inner end adjacent the gap to an opposed outer end;

the outer ends of the splines in the first set being spaced from the outer ends of the splines in the second set by a first distance;

each of the splines in the bore of the cam plate having a longitudinal length approximately the same as the first distance.

* * * * *

UNITED STATES PATENT AND TRADEMARK OFFICE

CERTIFICATE OF CORRECTION

PATENT NO. : 7,409,932 B2
APPLICATION NO. : 11/541440
DATED : August 12, 2008
INVENTOR(S) : Randall R. Gaiser It is certified that error appears in the above-identified patent and that said Letters Patent is hereby corrected as shown below:

Column 3, line 28, replace “itself of may” with --itself or may--

Column 3, line 38, replace “feeds by be” with --feeds may be--

Column 3, line 41, after “will” insert --be--

Signed and Sealed this

Eleventh Day of November, 2008

JON W. DUDAS
*Director of the United States Patent and Trademark Office*